US005904258A

United States Patent [19]

Farmer et al.

[11] Patent Number: 5,904,258

[45] Date of Patent: May 18, 1999

[54] BALLOON CENTERPIECE TEMPLATE

[76] Inventors: Raymond Farmer; Shelia M. Moore-Farmer, both of 7735 Mt. Hood, Huber Heights, Ohio 45424

[21] Appl. No.: 08/867,866

[22] Filed: Jun. 3, 1997

[51] Int. Cl.[6] ..... A47B 81/00

[52] U.S. Cl. ..... 211/206; 211/123; 211/124

[58] Field of Search ..... 211/206, 204, 211/105.1, 123, 124

[56] References Cited

U.S. PATENT DOCUMENTS

| | | | |
|---|---|---|---|
| 429,965 | 6/1890 | Sayers | 211/124 |
| 2,054,007 | 9/1936 | Sihler | 211/204 |
| 2,840,948 | 12/1958 | Stickley . | |
| 3,435,955 | 4/1969 | Brunette | 211/123 X |
| 4,589,854 | 5/1986 | Smith . | |
| 4,925,426 | 5/1990 | Lovik | 446/226 |
| 4,953,713 | 9/1990 | Yaffe . | |
| 5,004,633 | 4/1991 | Lovvik . | |
| 5,036,985 | 8/1991 | Lovik | 211/13.1 |
| 5,533,285 | 7/1996 | Skistimas et al. | 40/584 |
| 5,564,575 | 10/1996 | Casement | 211/13.1 |
| 5,568,875 | 10/1996 | Johnson et al. | 211/113 |
| 5,617,962 | 4/1997 | Chen | 211/206 |

FOREIGN PATENT DOCUMENTS

| | | | |
|---|---|---|---|
| 195888 | 8/1964 | Sweden | 211/206 |
| 1129 | 11/1995 | United Kingdom | 211/123 |

*Primary Examiner*—Daniel P. Stodola
*Assistant Examiner*—Gregory J. Strimbu
*Attorney, Agent, or Firm*—Patent & Trademark Services; Joseph H. McGlynn

[57] ABSTRACT

A template which can be used to assemble a balloon center piece. The template has a plurality of legs with connecting cross pieces and the cross pieces have fasteners spaced at specific intervals which will hold the balloons in position to form the balloon center piece with the proper spacing between the balloons.

1 Claim, 1 Drawing Sheet

FIG. 1
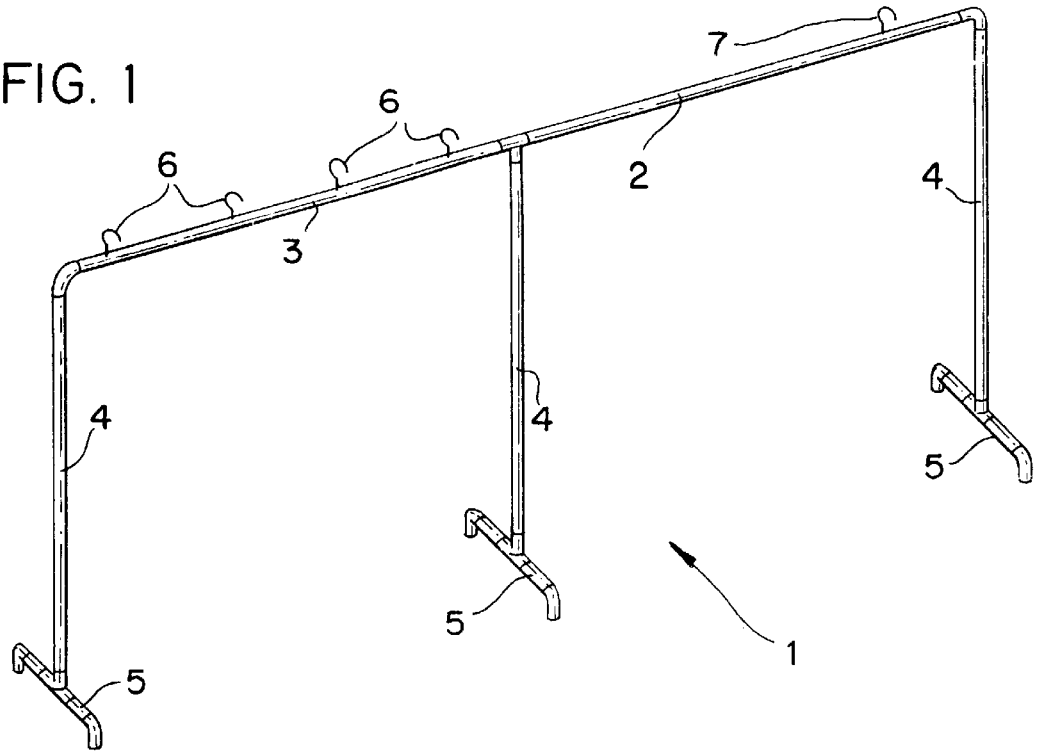
FIG. 2
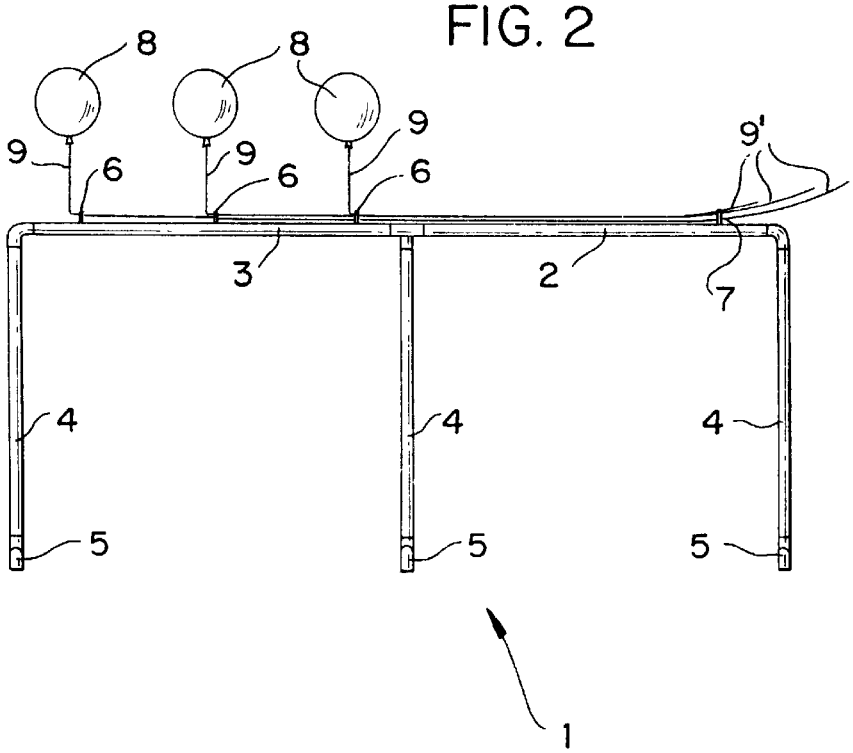
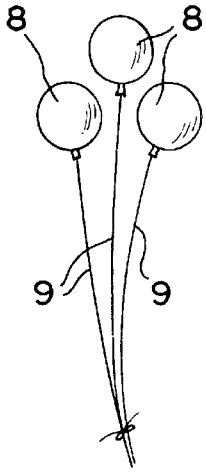
FIG. 3

BALLOON CENTERPIECE TEMPLATE

BACKGROUND OF THE INVENTION

This invention relates, in general, to a template, and, in particular, to to a template for assembling a balloon centerpiece.

DESCRIPTION OF THE PRIOR ART

In the prior art various types of decorative devices have been proposed. For example, U.S. Pat. No. 5,004,633 discloses a decorative device for balloons comprising a light weight plate like support element with a plurality of ribbon-like streamers attached thereto, and a plurality of balloons attached to the ribbons. U.S. Pat. No. 2,840,948 discloses a balloon holder having a shank with means for attaching a balloon at one end which consists of a circular upper portion and a plurality of arms attached thereto.

U.S. Pat. No. 4,953,713 discloses a balloon positioning device used to attach balloon clusters comprising a vertical cylinder with attachment points spaced therealong.

U.S. Pat. No. 4,589,854 discloses a nested balloon holder comprising a cone-shaped outer portion having an inner holder which is secured therein.

SUMMARY OF THE INVENTION

The present invention comprises a template which can be used to assemble a balloon center piece. The template has a plurality of legs with connecting cross pieces and the cross pieces have fasteners spaced at specific intervals which will hold the balloons in position.

The present invention was designed to provide an easier and more accurate way of assembling a balloon centerpiece or cluster. In a balloon centerpiece two, three or more helium balloons are attached to ribbons and the length of the ribbons are varied so the balloons are arranged in a staggered fashion.

Normally a large number of these centerpieces are made for a social function. For best appearances, the overall height and positioning of the balloons are very important. They must be uniform as far as the height of the first balloon and all subsequent balloons are concerned.

Methods used prior to the present invention required that the final positioning of the balloons be gauged by eye. When more than one person is working on the centerpiece, this becomes difficult to coordinate and uniformity is difficult.

The present invention is designed to overcome the short comings of the prior art.

It is an object of the present invention to provide a new assembly device for building a balloon centerpiece.

It is an object of the present invention to provide a new assembly device for building a balloon centerpiece which will accurately position the balloons no matter how many people are working on the centerpiece.

These and other objects and advantages of the present invention will be fully apparent from the following description, when taken in connection with the annexed drawings.

BRIEF DESCRIPTION OF THE DRAWINGS

FIG. 1 is a perspective view of the present invention before the balloons are attached.

FIG. 2 is a side view of the present invention with the balloons and ribbons attached.

FIG. 3 is a view of the finished balloon center piece.

DESCRIPTION OF THE PREFERRED EMBODIMENT

Referring now to the drawings in greater detail, FIG. 1 shows the framework 1 which will be used to assemble a balloon centerpiece. The framework or apparatus consists of plural foot rests 5 which will support an equal number of vertical supports 4. Attached to the supports 4 are two horizontal or top pieces 2, 3. The framework 1 shown in FIG. 1 is made from conventional ½ inch plastic pipe, however, this is merely for illustration purposes, and it should be understood that other sizes and other materials such as, but not limited to, wood or metal could also be used. Also, the horizontal top piece 2,3 could be a single piece instead of two separate pieces.

Attached to the top piece 2 is a plurality of hooks 6. The hooks 6 are spaced approximately 10 inches apart, however other dimensions could be used. An additional hook 7 is also attached to the top piece and is spaced approximately 32 inches from the last hook 6. It should be noted that while hooks are shown in the drawings, this is merely for illustration purposes and other attachment means can be used as long as they will perform the same function as the hooks.

In use, the user will first inflate the number of balloons 8 needed and attach ribbons 9' or some other flexible attachment means. Then the first ribbon attached to the first balloon is passed under the first hook 6. The second ribbon is passed under the second hook 6. Additional ribbons are attached to the remaining hooks 6 until all the ribbons are secured. The hooks will hold the ribbons and the balloons attached thereto at the proper positions, and the user will not have to be concerned about the proper spacing between balloons.

The loose ends of the ribbons (i.e. the ends which are not attached to the balloons) are pulled until all the balloons are positioned snug against their respective hooks. The ends of the ribbons are then tied around the hook 7 with a knot. The knot can be easily pulled off hook 7 and the balloons can also be easily pulled off their respective hooks 6.

The result is a perfect centerpiece. Using the centerpiece template, each centerpiece will be exactly the same, and anyone, even someone inexperienced, can make a perfect centerpiece. In addition, the template speeds up the process significantly.

Although the Balloon Centerpiece Template and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. The method of using an apparatus for assembling a ballon centerpiece, wherein said apparatus comprises a plurality of horizontal supports, a plurality of vertical supports, each of said vertical supports having a first end attached directly to a respective one of said plurality of horizontal supports, at least one additional horizontal support, said at least one additional horizontal support attached directly to a second end of each of said plurality of vertical supports, a plurality of first attachment means for attaching balloons to said at least one additional horizontal support, said plurality of first attachment means being secured directly to said at least one additional horizontal support, each one of said plurality of first attachment means having a first selected spacing between an adjacent one of said plurality of first attachment means, a second attachment means for attaching the balloons to said at least one additional horizontal support, said second attachment means being secured directly to said at least one additional horizontal support, said second attachment means having a second selected spacing from an adjacent one of said plurality of first attachment means, said second selected spacing being larger than said first selected spacing, wherein said method of use comprises:

A) inflating the balloons,

B) securing a flexible securing means to each respective one of the balloons,

C) attaching each of said flexible securing means to a respective one of said first attachment means so that said balloons are attached to said at least one additional horizontal support and to said plurality of vertical support, D) securing all of the flexible securing means to said second attachment means and to each other so that said balloons are attached to said at least one additional horizontal support and to said plurality of vertical support, E) removing each of said flexible securing means from said second attachment means and from said respective on of said first attachment means.

* * * * *